United States Patent [19]

Perne

[11] 4,076,140

[45] Feb. 28, 1978

[54] TAMPERPROOF CLOSURE ELEMENT

[75] Inventor: Raymond Perne, Morance, France

[73] Assignee: Astra Plastique, Saint-Georges de Reneins, France

[21] Appl. No.: 759,292

[22] Filed: Jan. 13, 1977

[51] Int. Cl.[2] ..... B65D 41/32

[52] U.S. Cl. ..... 215/256

[58] Field of Search ..... 215/256, 9, 251; 222/153

[56] References Cited

U.S. PATENT DOCUMENTS

| | | | |
|---|---|---|---|
| 3,424,330 | 1/1969 | Marcel | 215/256 |
| 3,817,416 | 6/1974 | Costa | 215/256 |
| 3,837,518 | 9/1974 | Gach | 215/256 |
| 3,871,545 | 3/1975 | Bereziat | 215/256 |
| 3,901,404 | 8/1975 | Feldman | 215/256 |
| 3,980,195 | 9/1976 | Fillmore | 215/256 |

FOREIGN PATENT DOCUMENTS

| | | | |
|---|---|---|---|
| 1,399,737 | 7/1975 | United Kingdom | 215/256 |

*Primary Examiner*—R. E. Hart

*Attorney, Agent, or Firm*—Dowell & Dowell

[57] ABSTRACT

A temperproof closure element integrally formed from molded synthetic material. The top cap section has a series of outwardly spaced projections which cooperate with mating inwardly spaced projections on a tear strip. A locking collar is provided with a similar series of inwardly spaced projections corresponding with mating outwardly directed projections on the same tear strip. The thickness of material along each of the set of mating projections is diminished providing a zone of reduced strength so that the tear strip can be removed prior to first use of the container containing the closure element.

2 Claims, 4 Drawing Figures

TAMPERPROOF CLOSURE ELEMENT

BACKGROUND OF THE INVENTION

The present invention relates to closure elements for containers and, in particular, a tamperproof closure element which is used to seal the necks of bottles and similar containers and assure the user that the contents have not been tampered with prior to first use.

It is known to provide such closure elements integrally molded from synthetic material in which a tear strip is attached to the body of the element by one or two annular zones of reduced strength so as to be easily torn off. This tear strip is used to retain the capsule element on the neck of the container and it is necessary to remove it before having access to the contents of the container.

The manner of providing these zones of reduced strength poses greater problems than might be expected. It is necessary that the tear strip be removed by the user without requiring excessive strength but, at the same time, it must have sufficient resistance to avoid accidental displacement during handling and transport. The requirement that the tear strip be easily removed also conflicts with two other requirements namely, that the reduced strength of the annular zone should not overly diminish the necessary axial rigidity of the closure element nor should it hinder the use of conventional automatic machines for insertion of the closure element. Further, it is important that when forming the closure element by injection molding, the zone of reduced strength should not require restricted flow passages which would cause the molding process to be extremely slow.

These differing requirements have led to different forms of closure element in the prior art. The areas of reduced strength have been produced by grooves or lines of spaced perforations, but neither of these arrangements has been totally satisfactory in practise.

SUMMARY OF THE INVENTION

The present invention provides an improved tamperproof closure element for containers. According to the invention a tamperproof closure element is provided comprising a body integrally formed from molded synthetic material having a tear strip formed as a ring attached to a top cap section by a zone of reduced strength adapted to be pulled off on first use. Each of the abutting edges of the cap section and tear strip is formed with a series of spaced projections extending radially towards the other edge, the series of projections being circumferentially displaced with respect to one another so that the projections of one series fit between the projections of the other. Each projection is joined to the adjacent projections of the other series by at least part of their abutting faces.

BRIEF DESCRIPTION OF THE DRAWINGS

A preferred embodiment of the invention will now be described, in conjunction with the accompanying drawings, to illustrate its characteristics and advantages.

DESCRIPTION OF THE PREFERRED EMBODIMENT

Figure 1:
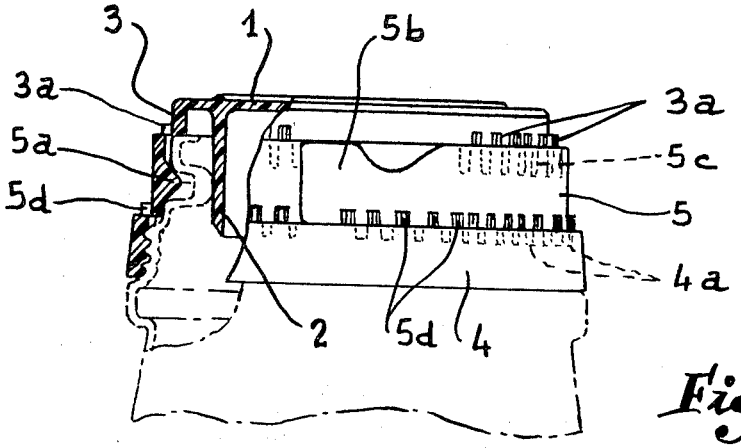
FIG. 1 is a side view, partially in section, of the closure element of this invention.
Figure 2:
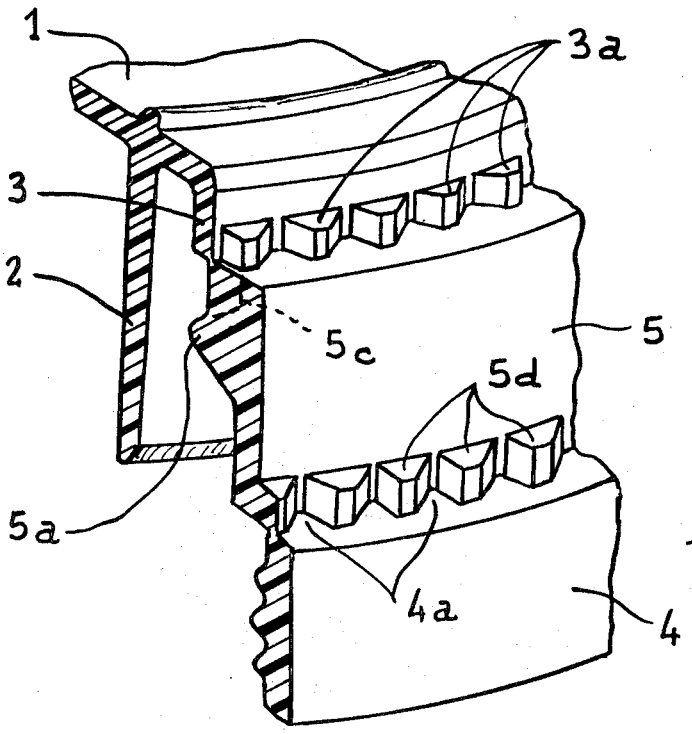
FIG. 2 is a perspective view on a larger scale showing the arrangement of the tear strip.
Figure 3:
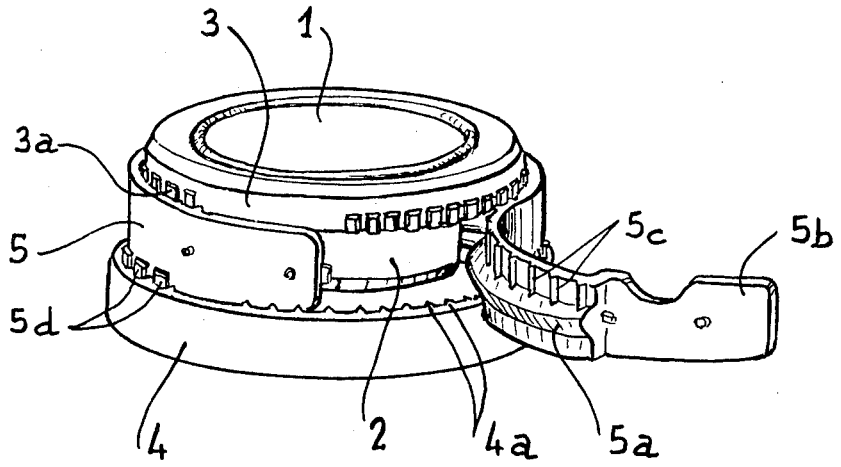
FIG. 3 is a perspective view showing the tear strip being ripped away in first use of the container associated with the closure.

Referring to FIG. 1, the closure element has a conventional base 1 formed integrally with a sealing lip 2 extending inside the neck of the bottle or other container to be closed. Base 1 is also provided with a shallow cylindrical skirt portion 3 which is, in turn, connected to a lower locking collar 4 by a tear strip 5 joined to skirt portion 3 and locking collar 4 by two annular zones of reduced strength. Tear strip 5 has on its inner wall an annular inwardly directed projection **5*a* adapted to be received in a corresponding groove conventionally provided in this type of container to prevent axial movement and, hence, removal of the top cap section. The locking collar 4 also has inwardly directed annular projections to fit in the normal series of axially spaced longitudinal grooves provided in the neck below the other groove mentioned above. It will be seen that the two ends of the tear strip partially overlap and are held together by frangible spikes. When released, the end 5*b*** provides a gripping element or tongue.

Figure 4:
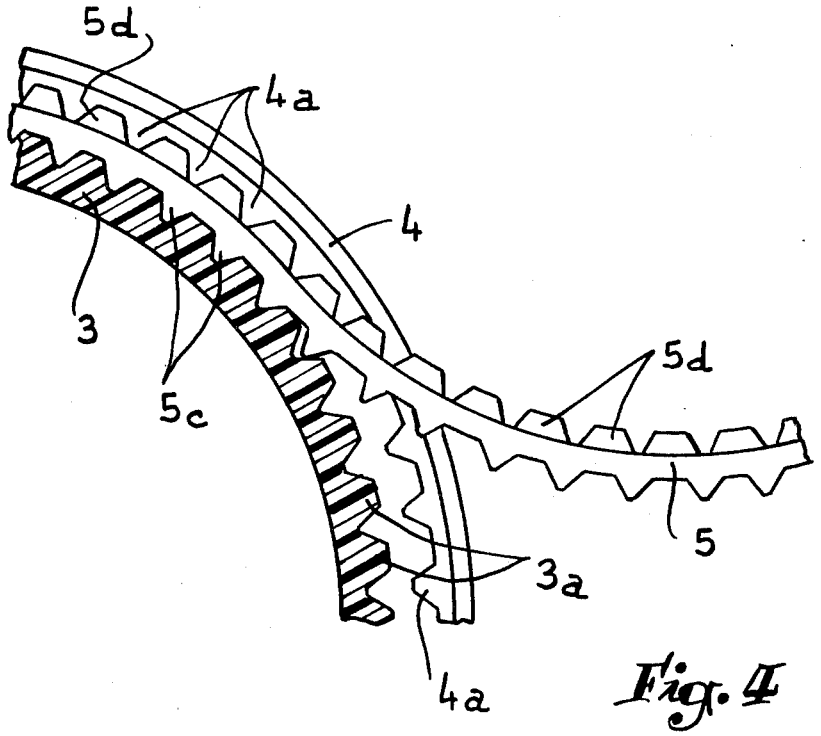
FIG. 4 is a detailed sectional view of the removal of the tear strip.

The annular junction between skirt portion 3 and tear strip 5 has a series of projections **3*a* extending outwardly on the outer wall of skirt portion 3 and another series of projections 5*c* extending inwardly from the inner wall of tear strip 5. As shown in greater detail in FIG. 4, projections 3*a* have a trapezoidal profile in horizontal section and define between them spaces with a triangular profile occupied by projections 5*c* of appropriate shape. This arrangement is reversed at the lower level junction between tear strip 5 and locking collar 4 in which a series of trapezoidal projections 5*d* are formed on the tear strip and a series of triangular projections 4*a* are formed on the upper surface of locking collar 4**.

It will be noted that this particular configuration, while providing two zones of reduced strength, still lends itself to the production of the closure by injection molding due to the absence of restricted flow passages which would cause the molding process to be slow. This advantage results from the continuous section formed by the projections **3*a* and 5*c* at the upper level and projections 5*d* and 4*a* at the lower level. Further, the interfitting of the two series of projections provides increased rigidity of the closure assembly and facilitates the insertion of the closure in bottles by standard automatic apparatus. It will also be noted that the tear strip 5 is protected from accidental tearing during handling and storage since it presents an outer smooth surface between the top cap section and the locking collar. In conjunction with these advantages, the tear strip 5 can easily be removed by the user. Pulling on the tongue 5*b*** encounters no significant resistance because of the thin layer of material joining the two series of projections at each level.

It will be noted that in distinction to known systems using perforations the tear strip according to this invention avoids the introduction of dust along the zones of reduced strength. There is no penetration of dust between the two series of projections.

It will be understood that the closure assembly of this invention can be applied to all types of containers. It will also be understood that this description is given only by way of example and various changes to the particular example given will be readily apparent to those skilled in the art.

We claim:

1. An improved tamperproof closure element to be applied to the neck of a container, the closure element having a top cap section joined to a tear strip which has a lower container gripping collar, the tear strip being attached to said cap section along abutting faces at an annular zone of reduced strength, the cap section and collar and tear strip being integrally formed of molded synthetic material, the improvement comprising at the annular zone between the tear strip and the cap section:

a first annular series of spaced projections extending radially from the section toward the tear strip;

a second annular series of spaced projections extending radially from the tear strip toward the section, the projections of said series being shaped to mutually interfit to provide a continuous closure; and the projections of each annular series of projections being partially axially displaced from the projections of the adjacent interfitting series of projections to reduce to a thin layer the material which joins the tear strip to the adjacent section where said projections are mated.

2. A closure element as set forth in claim 1, wherein said projections are shaped such that the thin layer of material where they mate defines a substantially trapezoidal intersection occupying a radial plane.

* * * * *